US005613421A

United States Patent [19]

Abe

[11] Patent Number: 5,613,421

[45] Date of Patent: Mar. 25, 1997

[54] RODLESS CYLINDER

[75] Inventor: Takashi Abe, Yawara-mura, Japan

[73] Assignee: SMC Corporation, Tokyo, Japan

[21] Appl. No.: 542,322

[22] Filed: Oct. 12, 1995

[30] Foreign Application Priority Data

Nov. 10, 1994 [JP] Japan ..... 6-301571

[51] Int. Cl.[6] ..... F15B 15/14

[52] U.S. Cl. ..... 92/165 PR; 92/172

[58] Field of Search ..... 92/164, 165 PR, 92/172

[56] References Cited

U.S. PATENT DOCUMENTS

| | | | |
|---|---|---|---|
| 3,027,877 | 4/1962 | Lansky | 92/164 X |
| 3,272,132 | 9/1966 | Stoelting et al. | 92/164 X |
| 4,351,229 | 9/1982 | Stoll | 92/172 X |
| 4,488,477 | 12/1984 | Miyamoto | 92/85 R |
| 4,744,287 | 5/1988 | Miyamoto | 92/165 PR X |
| 4,896,584 | 1/1990 | Stoll et al. | 92/165 PR X |
| 4,898,080 | 2/1990 | Lieberman | 92/165 PR X |
| 5,238,359 | 8/1993 | Chen | 92/165 PR X |

FOREIGN PATENT DOCUMENTS

| | | | |
|---|---|---|---|
| 1902100 | 8/1970 | Germany | 92/8 |
| 4-19214 | 4/1992 | Japan . | |

*Primary Examiner*—John Ryznic

*Attorney, Agent, or Firm*—Oblon, Spivak, McClelland, Maier & Neustadt, P.C.

[57] ABSTRACT

A substantially flat abutting surface 20*a* is provided on an outer side of a carriage member 6 which is axially movable along the outer periphery of a cylinder tube 2, while a rail 4 with a substantially flat guide surface 4*a* is mounted between a pair of end covers closing the opposite axial ends of the cylinder tube. Rotational movements of the carriage member 6 are restricted by the rail 4 which is located on the outer side of the carriage 6.

7 Claims, 3 Drawing Sheets

RODLESS CYLINDER

BACKGROUND OF THE INVENTION

1. Field of the Art

This invention relates to a magnet coupling type rodless cylinder.

2. Prior Art

Magnet coupling type rodless cylinders, which have been known in the art, are generally constituted by a cylinder tube formed of a non-magnetic material in a cylindrical shape, a pair of end covers closing the opposite axial ends of the cylinder tube, a piston received in the cylinder tube for hermetical sliding movements therein, a carriage member axially movably mounted on the cylinder tube to transfer an article along the outer periphery of the cylinder tube, and a magnet coupling provided between and coupling the cylinder tube and the carriage member with each other in such a way that the carriage member is moved in synchronism with the piston when the piston is moved axially within the cylinder tube by introduction of a compressed air pressure through an air charging and discharging port in either one of the end covers of the cylinder tube.

In a rodless cylinder of this sort, the carriage member is usually associated with a rotation blocking mechanism thereby to block rotational movements of the carriage member which would otherwise tend to turn about the cylinder tube. For instance, in case of Japanese Laid-Open Utility Model Application 62-19508 (Utility Model Publication H4-19214), rotational movements of a carriage member are blocked by a plural number of skewer type rods which are extended between end covers at the opposite axial ends of a cylinder tube through a carriage member.

However, conventional rotation blocking mechanisms which have a plural number of skewer type rods passed through a carriage member in such a manner invariably necessitate to increase the diameters of the carriage member and end covers for attachment thereto of the blocking skewer rods, resulting in a substantial increase in size of the rodless cylinder as a whole.

Therefore, there has been a demand for a rodless cylinder with a rotation blocking mechanism which is smaller in size and compact in construction as compared with the above-described conventional skewer rod type blocking mechanism.

In addition, for the purpose of detecting the operating position of a carriage member, in many cases rodless cylinders of this sort are provided with a position detection mechanism, which generally includes a rail member extended between the two end covers, a magneto-sensitive position detector switch mounted on the rail, and a magnet fixed on the carriage member.

For providing such a position detection mechanism on a conventional rodless cylinder, however, it becomes necessary to mount the rail member on the cylinder tube in addition to the afore-mentioned skewer type rods of the rotation blocking mechanism, resulting in a rodless cylinder which is further enlarged in size and complicated in construction involving an increased number of component parts.

These problems could be solved if one succeeds to provide a rotation blocking mechanism which is also capable of supporting a position detector switch in place of the rail member as used on the above-described prior art rodless cylinder. In such a case, measures should be taken to prevent malfunctioning of the position detector switch as caused under the influence of magnetic leakage from the magnet coupling. Besides, if arrangements are made to charge and discharge compressed air into and out of a pressure chamber on one side of the piston via the rotation blocking mechanism, it would become possible to make connections of all piping tubes to the rodless cylinder collectively through one of the end plates in an extremely convenient fashion.

SUMMARY OF THE INVENTION

It is a primary object of the present invention to provide a rodless cylinder of compact construction having a carriage member slidably mounted on a rotation blocking mechanism which is arranged to block rotational movements of the carriage member without use of skewer type rods, eliminating the spaces which would normally be occupied by a number of skewer type rods.

It is another object of the present invention to provide a rodless cylinder which is reduced in size and compact and simplified in construction through a significant reduction of the number of component parts, the rodless cylinder having a carriage member slidably mounted on a rotation blocking mechanism with a rail structure for supporting a position detector switch.

It is still another object of the present invention to provide a rodless cylinder with measures for securely preventing malfunctioning of a position detector switch, which might otherwise take place under the influence of magnetic leakage from the magnet coupling.

It is a further object of the invention to provide a rodless cylinder having a bypass passage in the above-mentioned rotation blocking mechanism, thereby permitting to charge and discharge compressed air into and out of a pressure chamber on one side of a piston and to complete connections of all piping tubes to and from the rodless cylinder collectively through one end plate of the cylinder.

In accordance with the present invention, the above-stated objectives are achieved by the provision of a rodless cylinder which essentially includes a cylinder tube of a hollow cylindrical shape, a carriage member to be moved axially along the outer periphery of the cylinder tube and having a substantially flat abutting surface on an outer side thereof, and a rail member securely mounted on the outer periphery of the cylinder tube between a couple of end plates closing the opposite ends of the cylinder tube and having substantially a flat guide surface to be engaged with the outer abutting surface of the carriage member to block rotational movements of the latter.

In a preferred form of the present invention, the carriage member is held in sliding contact with the guide surface on the rail member through a plural number of slide members provided on its abutting surfaces.

According to the present invention, a carriage position detector mechanism is integrally incorporated into the rotation blocking mechanism, the carriage position detector mechanism including a magnet which is embedded in a magnet receptacle groove on the abutting surface of the carriage member to cooperate with a position detector switch which is embedded in a switch receptacle groove on the part of the rail.

For the purpose of preventing malfunctioning of the carriage position detector switch, it is desirable to provide a magnetic shielding cover plate on the abutting surface of the carriage member to shield off magnetic leakage from a coupler magnet on the carriage member.

Further, according to the invention, a bypass passage for compressed air is provided within the rail member of the rotation blocking mechanism in communication with a port in one end cover and a pressure chamber on one side of a piston, permitting to charge and discharge compressed air through piping tubes which are connected to one of the end covers of the rodless cylinder collectively in a convenient fashion.

DESCRIPTION OF PREFERRED EMBODIMENTS

Figure 1:
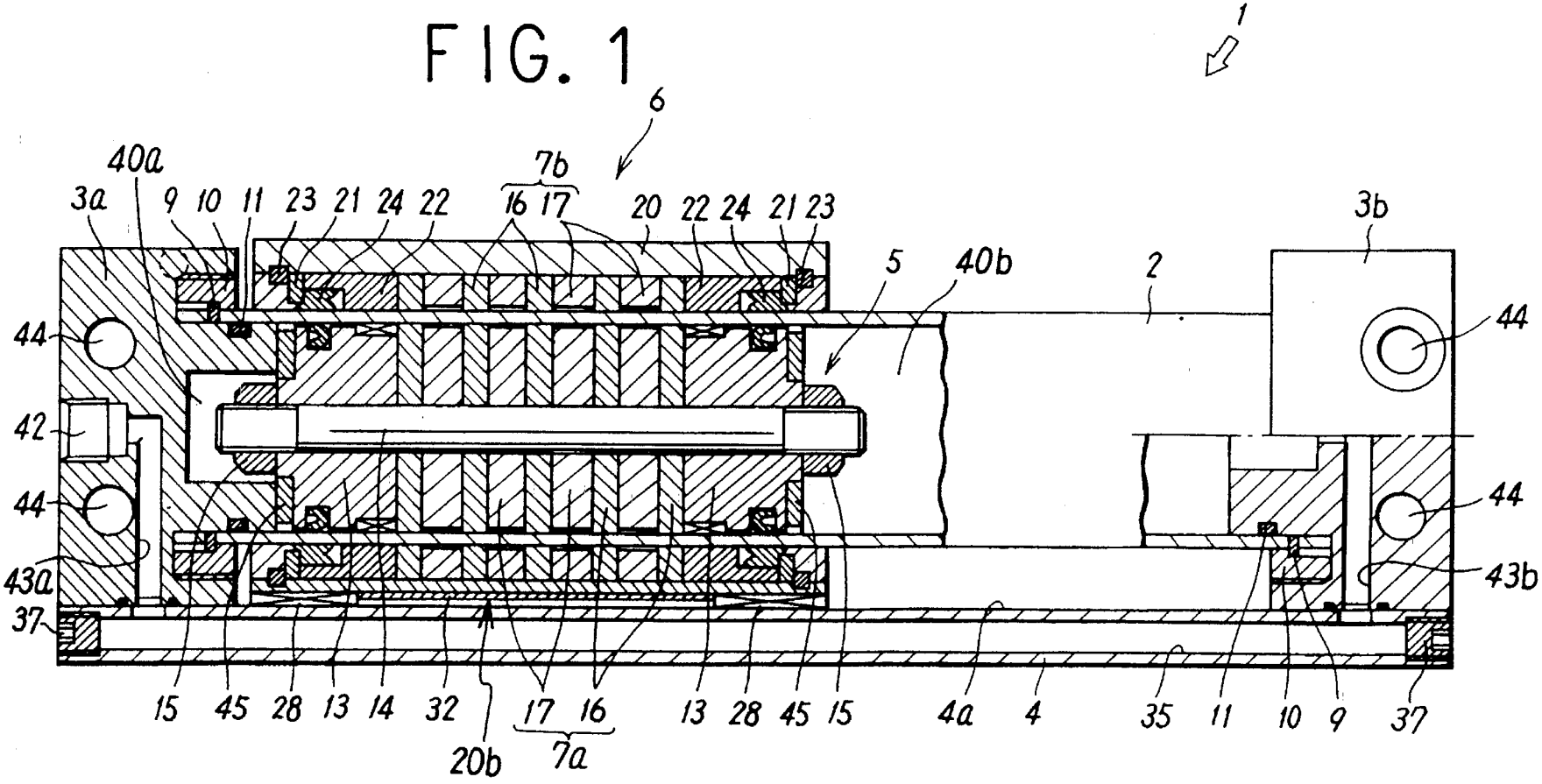
FIG. 1 is a longitudinal section of a rodless cylinder embodying the present invention.
Figure 2:
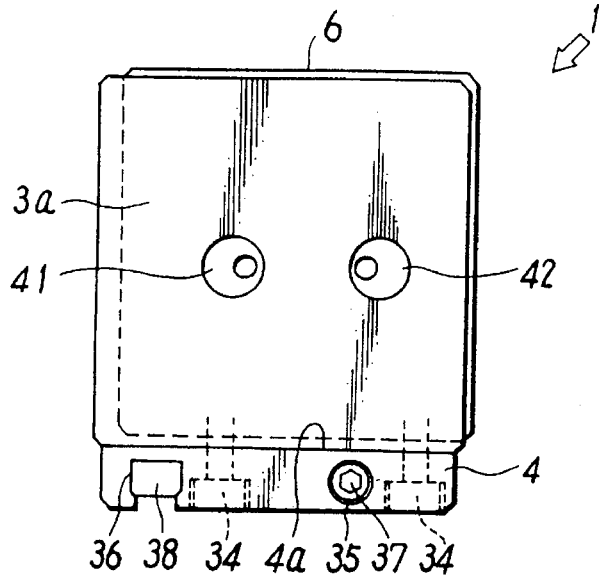
FIG. 2 is a side view of the embodiment of FIG. 1.

Referring to FIGS. 1 and 2, there is shown a rodless cylinder 1 embodying the present invention, including a cylinder tube 2 which is formed in a cylindrical shape by the use of a non-magnetic material such as aluminum or the like, a couple of square end cover plates 3*a* and 3*b* which close the opposite axial ends of the cylinder tube 2, a piston 5 which is hermetically slidably received in the cylinder tube 2, a carriage member 6 which is slidable axially on and along the outer periphery of the cylinder tube 2, and annular coupler magnets 7*a* and 7*b* which are provided on the piston 5 and carriage member 6 to connect them magnetically with each other. A rail member is securely fixed to the lower sides of the two end covers 3*a* and 3*b* for engagement with a substantially flat abutting surface 20*b* on the lower side of the carriage member 6.

Attachment rings 10, each tapped with an external or male screw thread, are rotatably fitted on the axially opposite ends of the cylinder tube 2 through stopper rings 9 which restrict axial movements of the respective attachment rings 10. The afore-mentioned end covers 3*a* and 3*b*, each tapped with a female screw thread, are threaded on the attachment rings 10 to close the axially opposite ends of the cylinder tube 2 hermetically through seal members 11 which are interposed between the cylinder tube 2 and the end covers 3*a* and 3*b*.

The piston 5 is constituted by a couple of annular piston members 13, and the coupler magnet 7*a* which is sandwiched between the piston members 13 and securely joined with the latter by a centrally passed shaft 14 and nuts 15. The coupler magnet 7*a* is constituted by a plural number of circular disk-like magnets 17 which are sandwiched between similarly circular disk-like yokes 16.

Figure 3:
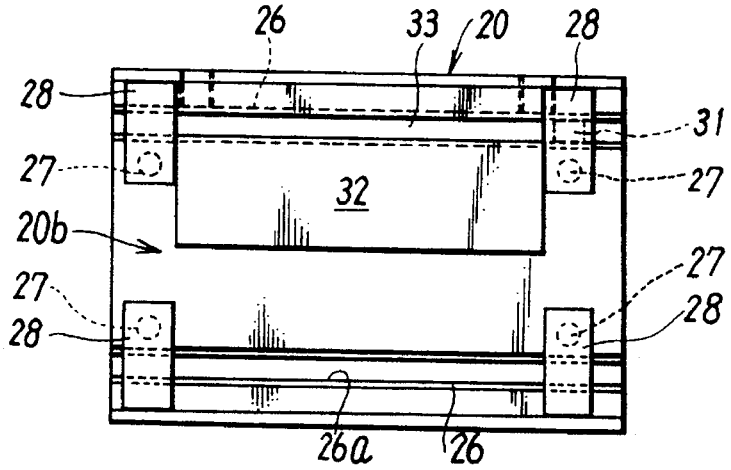
FIG. 3 is a bottom view of a body portion of a carriage member.
Figure 4:
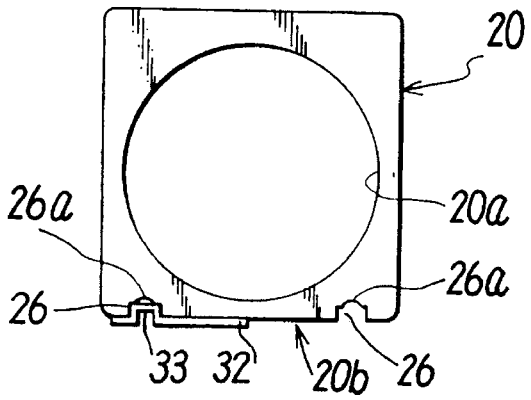
FIG. 4 is a schematic side view of the carriage body.

As seen in FIGS. 3 and 4, the carriage member 6 has a body 20 which is of a rectangular shape in side view and centrally provided with an axial through hole 20*a*. Fixedly fitted between a pair of stopper rings 23 on the inner periphery of the axial through hole 20*a* of the carriage body 20 are the other coupler magnet 7*b* of the magnet coupling, a pair of wear rings 22 which are located on the outer sides of the coupler magnet 7*b*, and a pair of annular spacers 21 which are located on the outer sides of the wear rings 22. The cylinder tube 2 slidably passed centrally of these internally fitted members of the carriage member 6.

Similarly to the coupler magnet 7*a* on the piston 5, the coupler magnet 7*b* on the side of the carriage member 6 is constituted by a plural number of magnets 17 which are sandwiched between yokes 16. Fitted between the above-described wear rings 22 and the spacers 21 are annular scrapers 24 which are held in sliding contact with the outer peripheral surfaces of the cylinder tube 2.

An abutting surface 20*b*, on the lower side of the carriage body 20 (facing toward the rail 4), is provided with axial magnet receptacle grooves 26 to receive therein a position detector magnet 31 of a short cylindrical shape at a position close to an axially end of the carriage member 6. These magnet receptacle grooves 26 are each provided with a magnet nesting pocket 26*a* of a semi-circular shape in section in which the magnet 31 just fits. Further, anchoring holes 27 for four slide members 28 are provided in four corner portions on the lower side of the carriage member 6 at positions close to the opposite longitudinal ends thereof.

Figure 5:
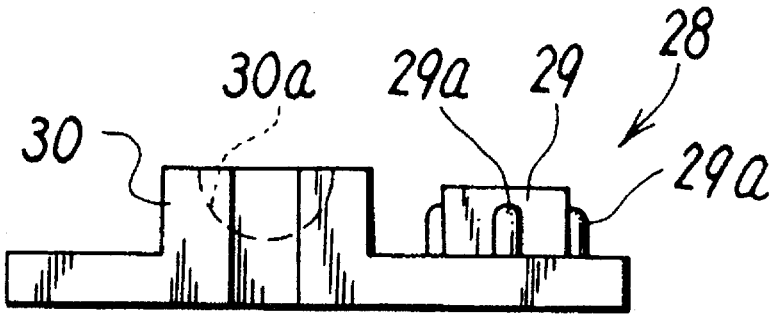
FIG. 5 is a schematic side view of a slide member.
Figure 6:
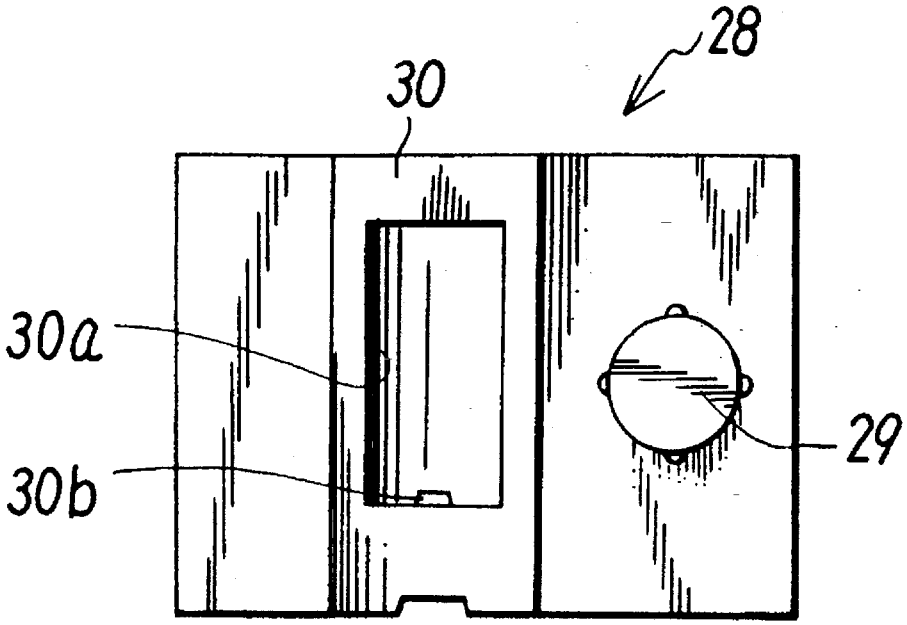
FIG. 6 is a schematic plan view of the slide member.

The four slide members 28, which are each formed of a synthetic resin material such as polyacetal or the like, have a function of blocking rotation of the carriage member 6 by maintaining sliding contact with the upper surface of the rail 7, and at the same time a function as a magnet holder for holding the magnet 31 in position whenever necessary. As shown in FIGS. 5 and 6, each slide member 28 is provided with a cylindrical stud portion 29 to be fitted in the anchoring hole 27, and a raised heel portion 30 to be fitted in the magnet nesting groove 26. The stud portion 29 is formed with a plural number of small protuberances 29 at spaced positions around its circumference to ensure tight fit in the anchoring hole 27. On the other hand, the heel portion 30 is formed with a magnet holder recess 30*a* of a semi-circular shape in section to receive the afore-mentioned magnet 31 therein. The magnet holder recess 30*a* is provided with a small projection 30*b* at one of its longitudinal ends thereby to hold the magnet 31 fixedly in position within the magnet holder recess 30*a*.

Each one of the slide members 28 can be set in position on the carriage body 20 simply by inserting the stud portion 29 in the anchoring hole 27. At this time, the upper half of the magnet 31 in the magnet holder recess 30*a* fits in the pocket 26*a* of the magnet receptacle groove 26.

The magnet 31 is not mounted on all of the slide members 28, but is mounted on one of the slide members 28 at one side of the carriage body which confronts a position detector switch 38 which is fixedly supported on the rail 4, as shown particularly in FIG. 3.

Further, for the purpose of shielding off lines of magnetic force of the magnets 17 of the coupler magnet 7*b*, a magnetic shielding plate 32 of a magnetic material, e.g., an iron plate, is attached to the lower side of the carriage body 20.

The magnetic shielding plate 32 is formed with a longitudinal stepped portion 33 which fits in the magnet receptacle groove 26. Upon fitting the stepped portion 33 in the groove 26, the magnetic shielding plate 32 is attracted on the carriage body 20 by the magnets 17 of the magnet coupling to cover the lower side of the carriage body 20 at least on the side of the magnet 31, namely, to cover the lower side of the carriage body 20 between the two slide members 28 which are located on the same side as the magnet 31. Consequently, movements of the magnetic shielding plate 32 in the longitudinal directions of the magnet receptacle groove 26 are restricted by the slide members 28, while its movements in directions perpendicular to the magnet receptacle groove 26 are restricted by the stepped portion 33 which is fitted in the magnet receptacle groove 26.

The above-described rail 4 is formed by extruding a non-magnetic material such as aluminum or the like into a flat plate-like shape, which has substantially the same width as the carriage body 20 in the transverse direction as shown in FIG. 2, and securely fixed to the lower sides of the end covers 3*a* and 3*b* at its opposite longitudinal ends by means of bolts 34.

On the upper side, the rail 4 is provided with a substantially flat guide surface 4*a* to be brought into sliding contact with the four slide members 28 on the abutting surface 20 of the carriage member 6. Through the sliding contact with the slide members 28, the rail 4 guides axial movements of the carriage member 6 while blocking rotational movements of the latter.

Further, a compressed air bypass passage 35 is formed internally of the rail 4 in a longitudinal direction thereof. A switch receptacle groove 36 for nesting the carriage position detector switch 38 is formed longitudinally on the lower side of the rail 4 at a position close to one of its lateral sides. The bypass passage 35 is communicated with flow passages 43*a* and 43*b* in the two end covers 3*a* and 3*b*, and closed with plugs 37 at its opposite ends. Adjustably set in the switch receptacle groove 26 are a couple of position detecting sensors 38 (only one of which is shown in the drawing) which are adapted to produce an output signal upon detection of the magnet 31 on the lower side of the carriage member 6. The position of each position detecting sensor 38 is adjustable in the longitudinal direction along the switch receptacle groove 36.

Opened in one of the end covers 3*a* and 3*b*, that is, in the end cover 3*a* in this particular embodiment are a first compressed air inlet/outlet port 41 and a second compressed air inlet/outlet port 42. The first inlet/outlet port 41 is directly communicated with a pressure chamber 40*a* on one side of the piston 5, while the second inlet/outlet port 42 is communicated with the other pressure chamber 40*b* through the passage 43*a* in the end cover 3*a*, the passage 35 in the rail 4 and the passage 43*b* in the other end cover 3*b*.

Accordingly, the above-described rodless cylinder 1 is capable of supplying compressed air to and from a couple of pressure chambers 43*a* and 43*b* via only one end cover 3*a* conveniently in a concentrated manner.

Indicated at 44 in FIG. 1 are holes to be used for mounting the rodless cylinder 1 on a predetermined support structure, and at 45 is a damper for buffering stopping motions of the piston 5.

With the rodless cylinder 1 of the above-described construction, the piston 5 is hermetically moved within the cylinder tube 2 upon charging and discharging compressed air through the ports 41 and 42 in the end cover 3*a*. At this time, the carriage member 6 is moved longitudinally along the outer periphery of the cylinder tube 2 in synchronism with the piston 5 by magnetic attracting forces of the opposingly disposed coupler magnets 7*a* and 7*b*. Therefore, a load which is put on the carriage member 6 is thereby transferred in the axial direction in synchronism with the piston movement.

In this instance, the slide members 28 which are fixedly anchored in four corner portions on the lower side of the carriage member 6 function to guide the carriage movement by sliding contact with the guide surface 4*a* of the rail 4, while additionally performing a function of blocking rotational movements of the carriage member 6. Therefore, the carriage member 6 is put in a smooth movement in the axial direction free of rotational movements about the cylinder tube 2.

The position of the carriage member 6 is detected through cooperation of the magnet 31 on the lower side of the carriage 6 and the position detection switch 38 which is mounted on the rail 4. In this embodiment, the magnetic shielding plate 32 which is attached to the lower side of the carriage member 6 shields off the magnetic forces of the magnet coupling to prevent malfunctioning of the position detecting sensor 38.

Thus, according to the present invention, a rotation blocking mechanism which restricts rotational movements of the carriage member is constituted by the rail which is arranged to abut against the lateral sides of the carriage member 6 from outside, obviating the use of a plural number of skewer type rods which need to be passed through the carriage body, and eliminating wasteful spaces for such skewer type rods to provide a rodless cylinder of compact construction.

Besides, since the rail member of the rotation blocking mechanism also serves as a switch holder for supporting the position detector switch in a predetermined fixed position, there is no necessity for providing an additional support structure exclusively for this purpose. Consequently, it becomes possible to provide a rodless cylinder of simplified and compact construction which involves only a reduced number of component parts. In addition, malfunctioning of the carriage position detector switch, which might be caused by magnetic leakage from the magnet coupling, is securely prevented by the magnetic shielding plate which is attached to the lower side of the carriage member.

Further, according to the invention, compressed air can be charged and discharged to and from a pressure chamber on one side of the piston through a bypass passage which is provided internally of the rail, permitting to effect air charging and discharging concentratedly through one end cover of the rodless cylinder.

What is claimed is:

1. A rodless cylinder of the type including a cylinder tube formed of a non-magnetic material in a hollow cylindrical shape, a pair of end covers closing the opposite axial ends of said cylinder tube, a piston hermetically slidably received in said cylinder tube, a carriage member to be moved axially along the outer periphery of said cylinder tube, and a magnet coupling provided between said piston and said carriage member to couple same magnetically with each other, moving said carriage member in synchronism with said piston by magnetic attraction of said magnet coupling when said piston is axially moved in said cylinder tube by charging and discharging compressed air through ports in said end covers, characterized in that said rodless cylinder comprises:

a substantially flat abutting surface formed on an outer side of said carriage member; and a rail member securely mounted on the outer periphery of the cylinder tube between said pair of end covers and having a substantially flat guide surface in contact with the said abutting surface of said carriage member to block rotational movements of the latter.

2. A rodless cylinder as defined in claim 1, wherein said carriage member is held in sliding contact with said guide surface through a plural number of slide members provided on said abutting surface.

3. A rodless cylinder as defined in claim 1, further comprising a magnet receptacle groove provided on said abutting surface of said carriage member, a magnet fixedly fitted in said magnet receptacle groove, a switch receptacle groove provided on said rail, and a position detector switch fixedly fitted in said switch receptacle groove to detect the position of said carriage member by way of the position of said magnet.

4. A rodless cylinder as defined in claim 2, further comprising a magnet receptacle groove provided on said abutting surface of said carriage member, a magnet fixedly fitted in position within said magnet receptacle groove by way of one of said slide member arranged to serve also as a magnet holder, a switch receptacle groove provided on said rail, and a position detector switch fixedly fitted in said switch receptacle groove to detect the position of said carriage member by way of the position of said magnet.

5. A rodless cylinder as defined in claim 3 or 4, further comprising a magnetic shielding plate attached on said abutting surface of said carriage member to shield off magnetic leakage from said magnet coupling.

6. A rodless cylinder as defined in any one of claims 1 to 4, further comprising a compressed air bypass passage provided in said rail member and communicated with a pressure chamber on one side of said piston through a port in one of said end covers in such a manner as to permit charging and discharging compressed air through piping tubes connected collectively to one of said end covers of said rodless cylinder.

7. A rodless cylinder as defined in claim 5, further comprising a compressed air bypass passage provided in said rail member and communicated with a pressure chamber on one side of said piston through a port in one of said end covers in such a manner as to permit charging and discharging of compressed air to and out of said cylinder tube through piping tubes connected collectively to one of said end covers of said rodless cylinder.

* * * * *